US009038585B2

(12) United States Patent
Kawai

(10) Patent No.: US 9,038,585 B2
(45) Date of Patent: May 26, 2015

(54) VALVE TIMING CONTROL APPARATUS

(71) Applicant: AISIN SEIKI KABUSHIKI KAISHA, Kariya-shi (JP)

(72) Inventor: Yoshiyuki Kawai, Nagoya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/202,246

(22) Filed: Mar. 10, 2014

(65) Prior Publication Data

US 2014/0251244 A1 Sep. 11, 2014

(30) Foreign Application Priority Data

Mar. 11, 2013 (JP) ..... 2013-048154
Nov. 7, 2013 (JP) ..... 2013-231396

(51) Int. Cl.
*F01L 1/34* (2006.01)
*F01L 1/344* (2006.01)

(52) U.S. Cl.
CPC ..... *F01L 1/3442* (2013.01); *F01L 2001/34456* (2013.01); *F01L 2001/34463* (2013.01)

(58) Field of Classification Search
CPC ..... F01L 1/3442; F01L 1/344
USPC ..... 123/90.17
See application file for complete search history.

(56) References Cited

U.S. PATENT DOCUMENTS

2010/0251981 A1* 10/2010 McCloy et al. ..... 123/90.17

FOREIGN PATENT DOCUMENTS

JP 2001-317314 A 11/2001

* cited by examiner

*Primary Examiner* — Zelalem Eshete
(74) *Attorney, Agent, or Firm* — Buchanan Ingersoll & Rooney PC

(57) ABSTRACT

A valve timing control apparatus includes: a drive-side rotor rotating in synchronization with a crankshaft of an internal combustion engine; a driven-side rotor arranged to have the same shaft center as the drive-side rotor, rotating in synchronization with a camshaft for opening and closing valves; a fluid pressure chamber formed between the drive-side driven-side rotors; a partitioning portion provided in at least one of the drive-side and driven-side rotors; a timing advance chamber and a timing delay chamber formed by partitioning the fluid pressure chamber by the partitioning portion; a lock mechanism including a lock member and a concave portion a lock release flow path through which operating fluid supplied and discharged to and from the concave portion is circulated; a valve arranged in the middle of the lock release flow path; and a control unit controlling the operation of the valve.

7 Claims, 10 Drawing Sheets

VALVE TIMING CONTROL APPARATUS

CROSS REFERENCE TO RELATED APPLICATIONS

This application is based on and claims priority under 35 U.S.C. §119 to Japanese Patent Applications 2013-048154 and 2013-231396, filed on Mar. 11, 2013 and Nov. 7, 2013, respectively, the entire contents of which are incorporated herein by reference.

TECHNICAL FIELD

This disclosure relates to a valve timing control apparatus controlling a relative rotation phase of a driven-side rotor with respect to a drive-side rotor rotating in synchronization with a crankshaft of an internal combustion engine.

BACKGROUND DISCUSSION

In recent years, a valve timing control apparatus capable of changing the opening and closing timing of an inlet valve and an exhaust valve in accordance with the operation status of an internal combustion engine (hereinafter also referred to as an engine) is in practical use. The valve timing control apparatus has a mechanism of changing the timing of opening and closing inlet and exhaust valves opened and closed in accordance with the rotation of the driven-side rotor by changing the relative rotation phase of the driven-side rotor with respect to the rotation of the drive-side rotor by actuation of the engine.

Generally, the optimum timing of opening and closing the inlet and exhaust valves differs according to the operation status of the engine such as at the time of starting the engine or at the time of running a vehicle. Accordingly, the relative rotation phase of the driven-side rotor with respect to the rotation of the drive-side rotor is constrained to a given phase between the most timing delay phase and the most timing advance phase at the time of starting the engine to thereby realize the optimum timing of opening and closing the inlet and exhaust valves. The valve timing control apparatus has a lock mechanism for constraining the relative rotation phase to the given phase.

As the lock mechanism provided in the valve timing control apparatus, for example disclosed in JP 2001-317314 A (Reference 1), there is the one in which a lock plate (corresponding to a lock mechanism of this disclosure) inserted into an outer rotor (corresponding to a drive-side rotor of this disclosure) is configured to be ejected and retracted in a radial direction of an inner rotor (corresponding to a driven-side rotor of this disclosure) and a torsion spring for biasing the lock plate to be pushed so that an end portion of the lock plate is fitted to a receiving groove (corresponding to a concave portion of this disclosure) is provided. In this device, the end portion of the lock plate is formed to be a shape tapered toward an end and a bottom portion of the receiving groove is formed to be a shape tapered toward the back to thereby facilitate the fitting between the lock plate and the receiving groove.

The above lock mechanism switches between a lock state in which the relative rotation phase is constrained to the given phase and a lock release state in which the constraint is released. The switching between the lock state and the lock release state is performed by supplying and discharging operating oil to the receiving groove through flow paths connecting to the receiving groove to thereby allowing the lock plate to be ejected and retracted to and from the receiving groove.

The switching from the lock state to the lock release state is performed based on, for example, the temperature, the rotation speed, the accelerator opening degree of the engine and so on.

However, in the valve timing control apparatus disclosed in Reference 1, the lock plate is ejected from the outside toward the inside in the radial direction to be fitted to the receiving groove. Accordingly, even when the biasing force of the torsion spring acts on the lock plate in the lock state, there is a danger that the lock plate is retracted from the receiving groove unintentionally and that the lock is released in the case where the centrifugal force generated by the rotation of the engine is higher than the biasing force.

Additionally, as the end portion of the lock plate has the tapered shape, an external force in a retracting direction may act on the lock plate due to the backlash between the outer rotor and the inner rotor occurring in a state where hydraulic pressure is not sufficient such as at the time of starting the engine. As a result, there is a danger that the lock plate is retracted from the receiving groove and that the lock is released even though the centrifugal force higher than the biasing force of the torsion spring does not occur.

Furthermore, as the related-art valve timing control apparatus, there is the one in which ejecting and retracting direction of the lock plate is set to a direction parallel to a camshaft. In such valve timing control apparatus, there is the one in which the end portion of the lock plate is deformed to a tapered shape due to abrasion or the one in which the end is processed to be the tapered shape in advance so as to facilitate the ejecting and retracting to and from the receiving groove. Also in these valve timing control apparatus, there is a danger that a component force in the retracting direction acts on the lock plate due to the backlash between the outer rotor and the inner rotor occurring at the time of starting the engine and that the lock plate is retracted unintentionally to be in the lock release state.

SUMMARY

Thus, a need exists for a valve timing control apparatus which is not suspectable to the drawbacks mentioned above.

An aspect of this disclosure provides a valve timing control apparatus including a drive-side rotor rotating in synchronization with a crankshaft of an internal combustion engine, a driven-side rotor arranged so as to have the same shaft center as the drive-side rotor, rotating in synchronization with a camshaft for opening and closing valves in the internal combustion engine, a fluid pressure chamber formed between the drive-side rotor and the driven-side rotor, a partitioning portion provided in at least one of the drive-side rotor and the driven-side rotor, a timing advance chamber and a timing delay chamber formed by partitioning the fluid pressure chamber by the partitioning portion, a lock mechanism having a lock member housed in any one of the drive-side rotor and the driven-side rotor and arranged so as to be ejected and retracted with respect to the other of the drive-side rotor and the driven-side rotor, and a concave portion formed in the other rotor so as to be fitted when the lock member is ejected, in which switching can be performed between a lock state where the lock member is ejected to be fitted to the concave portion to thereby allow a relative rotation phase of the driven-side rotor with respect to the drive-side rotor to be constrained to a given phase and a lock release state where the lock member is retracted from the concave portion to thereby release the constraint, a lock release flow path through which operating fluid supplied and discharged to and from the concave portion is circulated, a valve arranged in the middle of the lock release flow path, having a shutoff mode in which neither supply nor discharge of the operating fluid to and from the concave portion is performed and a control unit controlling the operation of the valve, in which the valve becomes in the shutoff mode just after the internal combustion engine is started to thereby shut off supply and discharge of the operating fluid to and from between the valve in the lock release flow path and the concave portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Figure 1:
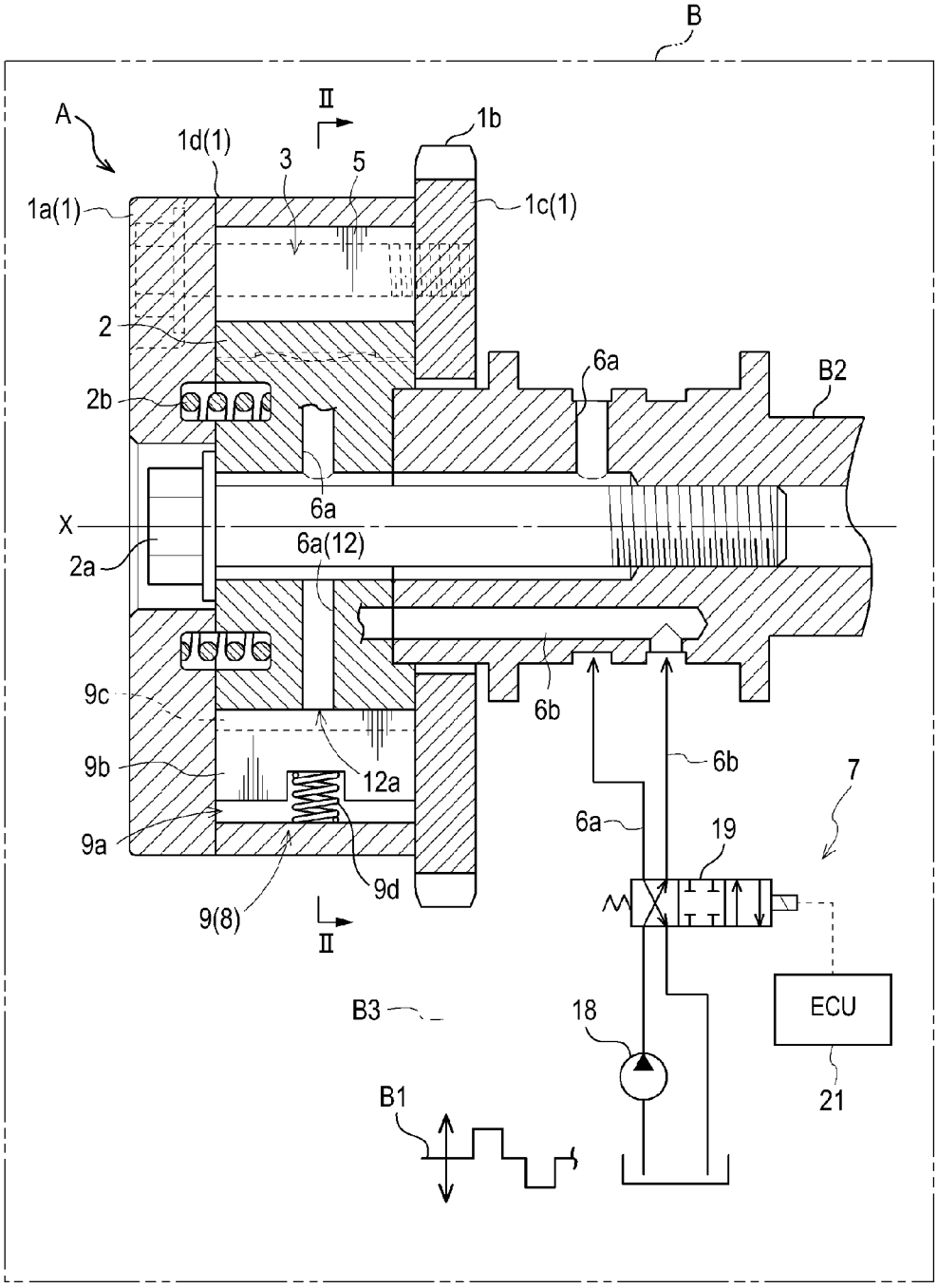
FIG. 1 is a vertical cross-sectional view showing a structure of an internal combustion control system including a valve timing control apparatus according to a first embodiment.

A first embodiment disclosed here will be explained with reference to the drawings below. FIG. 1 shows a structure of an internal combustion control system including a valve timing control apparatus A setting the opening and closing timing of an inlet valve (not shown) in an engine B as an internal combustion engine and an engine control unit (ECU) 21 controlling the engine B. The ECU 21 is an example of a control unit. The valve timing control apparatus A includes a housing 1 made of a metal such as a sintered metal or an aluminum alloy as a drive-side rotor which rotates in synchronization with a crankshaft B1 of the engine B and an inner rotor 2 made of a sintered metal as a driven-side rotor which is coaxially arranged inside the housing 1 and rotates in synchronization with a camshaft B2 for opening and closing valves of the engine B.

As shown in FIG. 1, a front plate 1*a*, a rear plate 1*c* which is integrally provided with a timing sprocket 1*b* and an outer rotor ld assembled between them are integrated into the housing 1 by being fastened by screws and so on. The inner rotor 2 is fixed to an end portion of the camshaft B2 so as to be integrated with the camshaft B2 by a bolt 2*a*, which is assembled so as to relatively rotate with respect to the housing 1 within a fixed range of angles. The camshaft B2 is a rotation shaft of a cam (not shown) for controlling opening and closing the inlet valve of the engine B, which is assembled to a cylinder head (not shown) of the engine B so as to rotate freely. The housing 1 is an example of the drive-side rotor and the inner rotor 2 is an example of the driven-side rotor.

Figure 2:
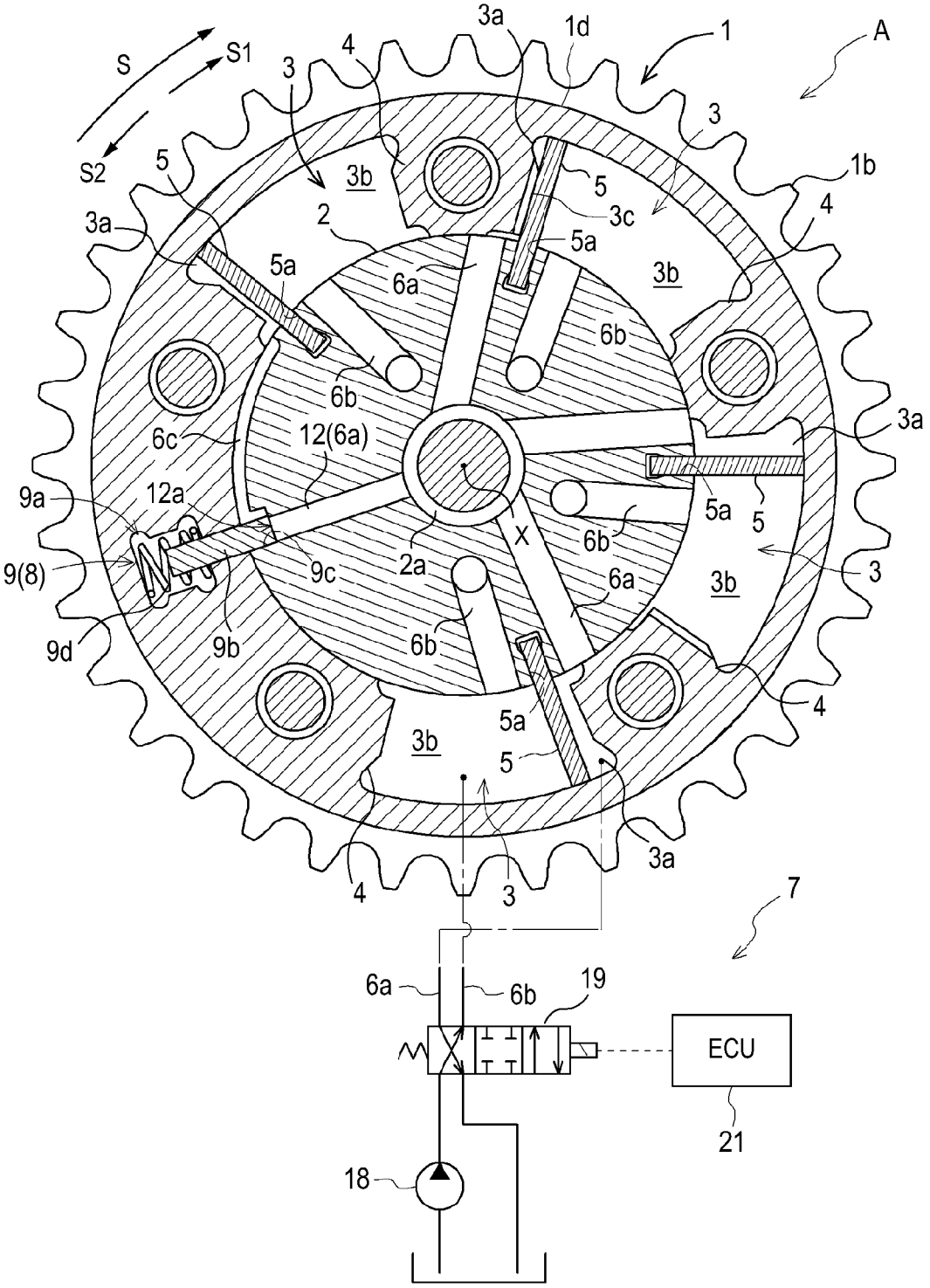
FIG. 2 is a cross-sectional view taken II-II line in FIG. 1.

When the crankshaft B1 is rotationally driven, the rotational drive force is transmitted to the timing sprocket 1*b* through a power transmission member B3, and the housing 1 rotates in a rotational direction shown by an arrow S in FIG. 2. With the rotation of the housing 1, the inner rotor 2 is driven-rotated in the rotational direction S to rotate the camshaft B2, as a result, the cam provided in the camshaft B2 opens and closes the inlet valve of the engine B.

As shown in FIG. 2, four fluid pressure chambers 3 are formed between the housing 1 and the inner rotor 2. The fluid pressure chambers 3 are partitioned by four projections 4 formed so as to project into the inside of the radial direction with a gap therebetween in the rotational direction S on the inner peripheral side of the outer rotor 1*d*. Though the number of the fluid pressure chambers 3 is four in the present embodiment, it is not limited to this.

Vane grooves 5*a* are formed in outer peripheral portions of the inner rotor 2 facing the respective fluid pressure chambers 3, and vanes 5 forming partitioning portions are attached in these vane grooves 5*a* so as to slide along the radial direction. The vane 5 is an example of a partitioning portion. The vanes 5 are biased outward in the radial direction by springs (not shown) provided on the bottom of the vane grooves 5*a*.

Each fluid pressure chamber 3 is partitioned into a timing advance chamber 3*a* and a timing delay chamber 3*b* by the vane 5. The timing advance chamber 3*a* and the timing delay chamber 3*b* are respectively connected to a timing advance flow path 6*a* and a timing delay flow path 6*b* formed in the inner rotor 2. A fluid supply and discharge mechanism 7 for supplying and discharging operating fluid (hereinafter referred to as operating oil) to and from the timing advance chamber 3*a* and the timing delay chamber 3*b* through the timing advance flow path 6*a* and the timing delay flow path 6*b* is provided. The details of the fluid supply and discharge mechanism 7 will be described later.

As shown in FIG. 1, a torsion spring 2*b* is provided over the inner rotor 2 to the front plate 1*a*. The device is biased by a biasing force of the torsion spring 2*b* so that a relative rotation phase between the housing 1 and the inner rotor 2 (hereinafter also referred to merely as a relative rotation phase) will be in a timing advance direction (direction in which the capacity of the timing advance chamber 3*a* is increased) shown by an arrow S1. The torsion spring 2*b* may bias the device so that the relative rotation phase between the housing 1 and the inner rotor 2 will be in a timing delay direction (direction in which the capacity of the timing delay chamber 3*b* is increased) shown by an arrow S2.

The valve timing control apparatus A has a lock mechanism 8 constraining the relative rotation phase between the housing 1 and the inner rotor 2 to the most timing delay phase (phase in which the capacity of the timing delay chamber 3*b* will be the maximum). The most timing delay phase is the optimum given phase for starting the engine B or a phase suitable for reducing exhaust gas within a range in which the engine B can be started. The most timing delay phase is an example of the given phase in the embodiment.

The lock mechanism 8 has a first lock portion 9 and a switching mechanism which can switch freely between a lock state in which the relative rotation phase is constrained to the most timing delay phase and a lock release state in which the constraint is released. As shown in FIG. 2, the lock mechanism 8 constrains the relative rotation phase to the most timing delay phase by constraining the relative rotation of the inner rotor 2 with respect to the housing 1 by the control by the first lock portion 9 and the control by the abutment between the vane 5 and a stopper 3*c* of the timing advance chamber 3*a*. The first lock portion 9 is arranged in one protrusion 4.

The first lock portion 9 has a plate-shaped first lock member 9*b* housed in a first insertion portion 9*a* formed in the outer rotor 1*d* so as to be ejected and retracted toward the inside of the radial direction. In the embodiment, the first lock member 9*b* is an example of a lock member. The first lock portion 9 also has a groove-shaped first concave portion 9*c* formed in the inner rotor 2 so that an end portion of the first lock member 9*b* enters. In the embodiment, the first concave portion is an example of a concave portion. The first lock portion 9 further has a compressed coil spring 9*d* projecting and biasing the first lock member 9*b* toward the inside of the radial direction. A lock release flow path 12 is formed in the first concave portion 9*c* from the bottom face toward a rotation shaft center X.

As shown in FIG. 2, a communicating flow path 6*c* communicating the first concave portion 9*c* to the timing advance chamber 3*a* is formed on an outer peripheral surface of the inner rotor 2. Accordingly, the operating oil supplied to the first concave portion 9*c* through the lock release flow path 12 for releasing the lock is supplied to the timing advance chamber 3*a* further through the communicating flow path 6*c*. That is, the lock release flow path 12 is used in common with one of the timing advance flow paths 6*a*.

In the first lock portion 9, when the first lock member 9*b* faces the first concave portion 9*c* by the relative rotation of the housing 1 and the inner rotor 2 in a state where the operating oil is discharged from the first concave portion 9*c* through the lock release flow path 12, that is, when the relative rotation phase reaches the most timing delay phase, the first lock member 9*b* enters the first concave portion 9*c* due to biasing force of the compressed coil spring 9*d*.

Figure 3:
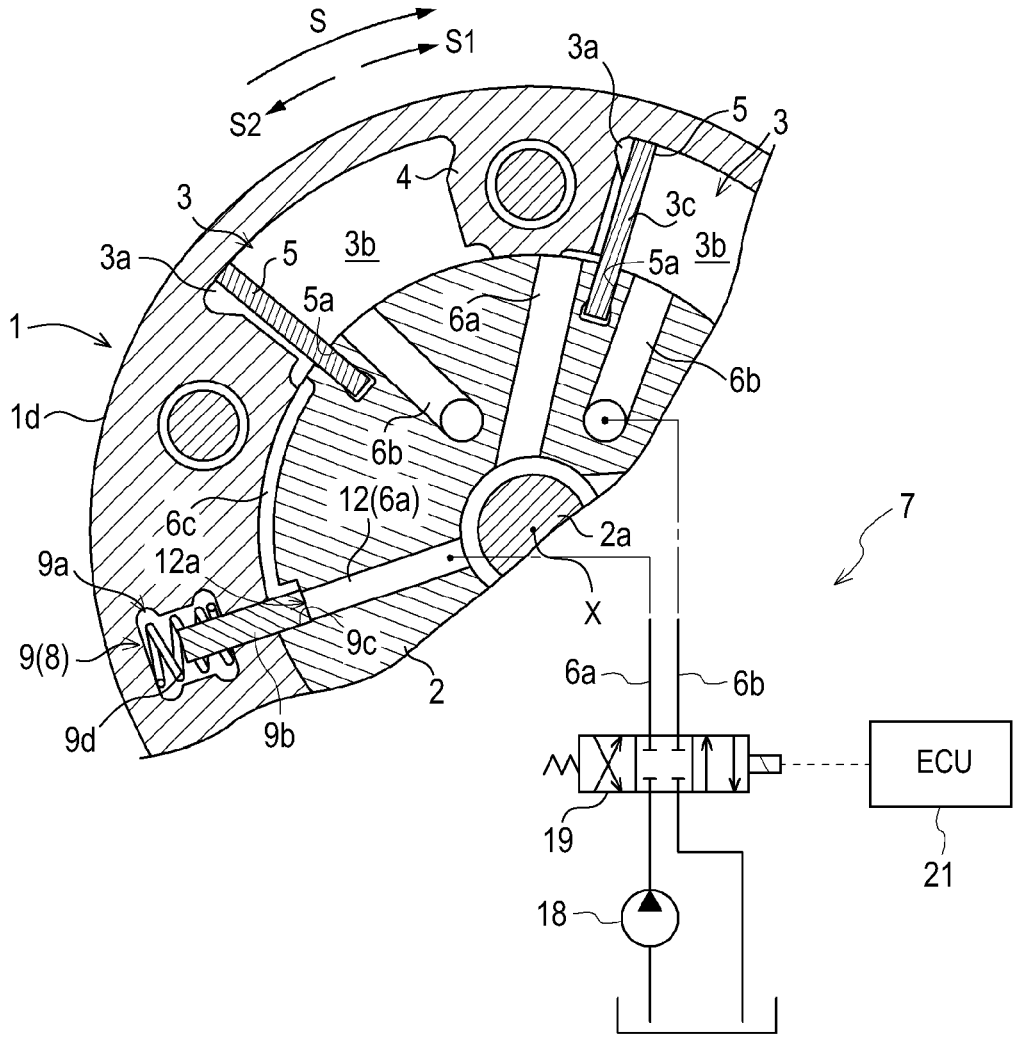
FIG. 3 is an enlarged cross-sectional view of a lock mechanism just after starting an engine.
Figure 4:
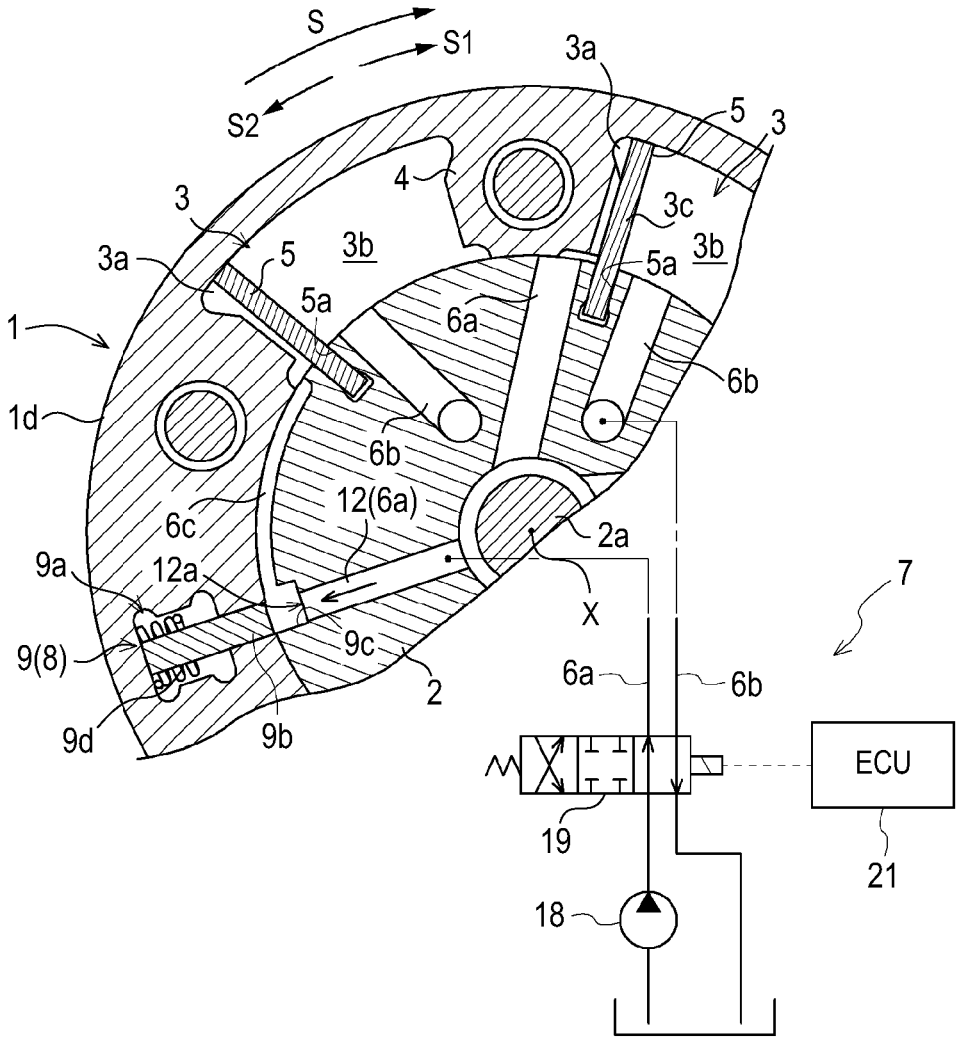
FIG. 4 is an enlarged cross-sectional view of the lock mechanism, which shows a lock release state.

As shown in FIG. 2 and FIG. 3, the state in which the first lock member 9*b* enters the first concave portion 9*c* as well as the vane 5 abuts on the stopper 3*c* is a lock state in which the relative rotation phase is constrained to the most timing delay phase. As shown in FIG. 4, the state in which the first lock member 9*b* is retracted from the first concave portion 9*c* as operating oil is supplied to the first concave portion 9*c* through the lock release flow path 12 is the lock release state in which the relative rotation phase is not constrained. The switching control between the lock state and the lock release state is performed by the ECU 21.

Next, the fluid supply and discharge mechanism 7 will be explained. As shown in FIG. 1, the fluid supply and discharge mechanism 7 includes a mechanical oil pump 18 driven by the engine B and supplying the operating oil and a spool OCV (oil control valve) 19 as a switching mechanism for controlling supply/discharge of the operating oil with respect to the timing advance flow path 6*a* and the timing delay flow path 6*b*, and the ECU 21 controls actuation of the oil pump 18 and the OCV 19. In the embodiment, the OCV 19 is an example of a valve.

The ECU 21 changes the position of the spool valve by controlling the conduction amount to the OCV 19, thereby executing the timing advance control in which the operating oil is supplied to the timing advance chamber 3*a* and the operating oil is discharged from the timing delay chamber 3*b*, the timing delay control in which the operating oil is supplied to the timing delay chamber 3*b* and the operating oil is discharged from the timing advance chamber 3*a*, and the shutoff control in which supply and discharge of the operating oil to and from the timing advance chamber 3*a* and the timing delay chamber 3*b* are shut off.

In the embodiment, an operating oil path capable of performing the timing advance control is formed when the conduction amount to the OCV 19 is the maximum. The operating oil is supplied from the timing advance flow path 6*a* and increases the capacity of the timing advance chamber 3*a* to thereby be in a timing advance mode in which the relative rotation phase of the inner rotor 2 with respect to the housing 1 is displaced in the timing advance direction S1. An operating oil path capable of performing the timing delay control is formed when the conduction to the OCV 19 is cut off. The operating oil is supplied from the timing delay flow path 6*b* and increases the capacity of the timing delay chamber 3*b* to thereby be in a timing delay mode in which the relative rotation phase is displaced in the timing delay direction S2. When the duty of the conduction amount is 50%, the device is in a shutoff mode in which both supply and discharge of the operating oil to and from the timing advance chamber 3*a* and the timing delay chamber 3*b* are shut off. As the operating oil is supplied also to the first concave portion 9*c* through the lock release flow path 12 (timing advance flow path 6*a*) at the time of the timing advance control, the timing advance mode is referred to as a supply mode when focusing attention to the supply of the operating oil to the first concave portion 9*c*. As the operating oil is discharged also from the first concave portion 9*c* through the lock release flow path 12 at the time of the timing delay control, the timing delay mode is referred to as a discharge mode when focusing attention to the discharge of the operating oil from the first concave portion 9*c*.

Next, the operation of the valve timing control apparatus A will be explained. As shown in FIG. 2, in the state where ignition is turned off and the engine B is stopped, the valve timing control apparatus A is in the lock state in which the relative rotation phase of the inner rotor 2 with respect to the housing 1 is constrained to the most timing delay phase, and the first lock member 9*b* is fitted to the first concave portion 9*c*. At this time, the first lock member 9*b* is biased by the compressed oil spring 9*d*.

As the conduction to the OCV 19 is cut off in the state where the engine B is stopped, the OCV 19 is in the timing delay mode. However, as the oil pump 18 is not driven in the state where the engine B is stopped, the operating oil is not supplied to the timing delay chamber 3*b*. Accordingly, there is little operating oil in the timing advance flow path 6*a* and the timing delay flow path 6*b*, and air may mainly exist there.

When the engine B is started, the ECU 21 controls the OCV 19 to be conducted at 50%, and the OCV 19 is switched to the shutoff mode shown in FIG. 3. Accordingly, both supply and discharge of the operation oil are not performed with respect to the timing advance flow path 6*a* and the timing delay flow path 6*b*, and the timing advance flow path 6*a* which is used in common with the lock release flow path 12 is closed by the first lock member 9*b* and the OCV 19.

While the engine B is warmed up, the ECU 21 performs control of maintaining the lock state. Also in this state, the centrifugal force higher than the biasing force of the compressed coil spring 9*d* or the external force in a retracting direction caused due to the backlash between the housing 1 and the inner rotor 2 may act on the first lock member 9*b*. However, the first lock member 9*b* is not completely retracted even when such centrifugal force or external force acts thereon. This is because a little amount of operating oil remains in a gap between the first lock member 9*b* and the first concave portion 9*c* to thereby secure the sealed state in the vicinity of an opening 12*a*. That is, as the lock release flow path 12 is closed by the first lock member 9*b* and the OCV 19, not only the operating oil is not supplied/discharged but also air does not enter, and negative pressure is generated inside the lock release flow path 12 against the operation of the force in the retracting direction of the first lock member 9*b*, which cancels out or reduces the force in the retracting direction of the first lock member 9*b*.

After that, when the warm-up of the engine B is finished and an accelerator is stepped on for starting normal driving of the vehicle, the ECU 21 controls the OCV 19 to increase the conduction amount to the maximum to thereby switch the OCV 19 to the timing advance mode, as a result, the operating oil is supplied to the first concave portion 9*c* through the lock release flow path 12 and hydraulic pressure in a direction of releasing the lock acts on the first lock member 9*b*. Due to the hydraulic pressure, the first lock member 9*b* is retracted from the first concave portion 9*c* against the biasing force of the compressed coil spring 9*d*, and the lock mechanism 8 becomes in the lock release state as shown in FIG. 4. Then, when the lock of the first lock portion 9 is released, the operating oil supplied to the first concave portion 9*c* is supplied to the timing advance chamber 3*a* after flowing through the communicating flow path 6*c*, and the relative rotation phase of the inner rotor 2 with respect to the housing 1 is displaced in the timing advance direction S1. After that, the ECU 21 can displace the relative rotation phase in the timing advance direction S1 or the timing delay direction S2 by controlling the conduction amount to the OCV 19.

As described above, when the OCV 19 is switched to the shutoff mode just after starting the engine B, the centrifugal force or the external force in the retracting direction which may act on the first lock member 9*b* is cancelled out or reduced by the negative pressure generated in the timing advance flow path 6*a*, therefore, it is possible to prevent the first lock member 9*b* from being retracted and from releasing the lock state against the control.

Second Embodiment

Figure 5:
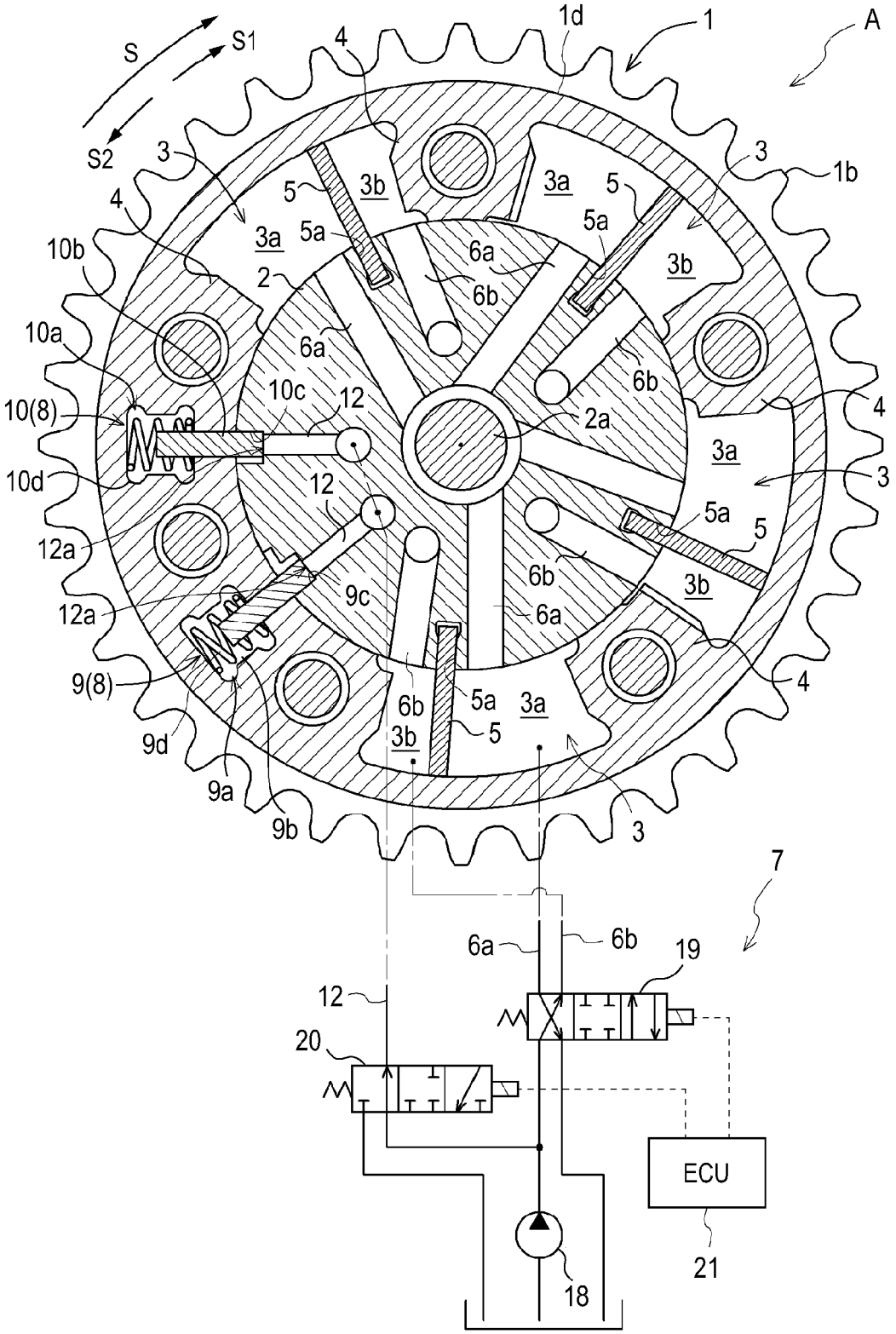
FIG. 5 is a horizontal cross-sectional view showing a structure of a valve timing control apparatus according to a second embodiment.

Next, a second embodiment disclosed here will be explained with reference to the drawings. In the following description of the embodiment, portions having the same structures as the first embodiment are denoted by the same reference signs and explanation for the same structures is omitted. The valve timing control apparatus A according to the embodiment differs from the first embodiment chiefly in the following three points. First, as shown in FIG. 5, the lock mechanism 8 constrains the phase to an intermediate lock phase between the most timing advance phase (the phase in which the capacity of the timing advance chamber 3*a* increased to the maximum) and the most timing delay phase. Secondly, the lock release flow path 12 and the timing advance flow path 6*a* are completely independent to each other (there is no flow path to be used in common). Thirdly, supply/discharge/shutoff of the operating oil with respect to the lock release flow path 12 are switched by a spool OSV (oil switching valve) 20 provided separately from the OCV 19. Other structures are the same. In the embodiment, the OSV 20 is an example of a valve and the intermediate lock phase is an example of a given phase. The intermediate lock phase is the optimum given phase for starting the engine B or a phase suitable for reducing exhaust gas within a range in which the engine B can be started.

The lock mechanism 8 according to the embodiment includes the first lock portion 9, a second lock portion 10 and a switching mechanism which can switch freely between the lock state in which the phase is constrained to the intermediate lock phase and the lock release state in which the constraint is released.

As shown in FIG. 5, the lock mechanism 8 constrains the relative rotation phase between the housing 1 and the inner rotor 2 to the intermediate lock phase by constraining the relative rotation of the inner rotor 2 with respect to the housing 1 by the first lock portion 9 and the second lock portion 10. The first lock portion 9 and the second lock portion 10 are arranged at one common protrusion 4 so that the second lock portion 10 is positioned on the downstream side in the rotation direction S with respect to the first lock portion 9. The first lock portion 9 and the second lock portion 10 may be arranged at one common protrusion 4 so that the second lock portion 10 is positioned on the upstream side in the rotation direction S with respect to the first lock portion 9.

The first lock portion 9 and the second lock portion 10 respectively include the plate-shaped first lock member 9*b* and a second lock member 10*b* housed in the first insertion portion 9*a* and a second insertion portion 10*a* formed in the outer rotor 1*d* toward the inside of the radial direction so as to be ejected and retracted. In the embodiment, both the first lock member 9*b* and the second lock member 10*b* are examples of lock members. The first lock portion 9 and the second lock portion 10 respectively include the first concave portion 9*c* and a second concave portion 10*c* formed in the inner rotor 2 so that end portions of the first lock member 9*b* and the second lock member 10*b* enter. In the embodiment, the first concave portion 9*c* and the second concave portion 10*c* are respectively examples of concave portions. Furthermore, the first lock portion 9 and the second lock portion 10 include compressed coil springs 9*d* and 10*d* projecting and biasing the first lock member 9*b* and the second lock member 10*b* toward the inside of the radial direction. The lock release flow paths 12 are formed respectively in the first concave portion 9*c* and the second concave portion 10*c* from the bottom faces toward the rotation shaft center X.

The first lock member 9*b* and the second lock member 10*b* are attached in a posture in which plate surfaces extend along the rotation shaft center X so as to be ejected and retracted with respect to the inner rotor 2 along the rotation radial direction. The first concave portion 9*c* and the second concave portion 10*c* are formed in a groove shape so that a longitudinal direction thereof extends along the rotation shaft center X.

Figure 6:
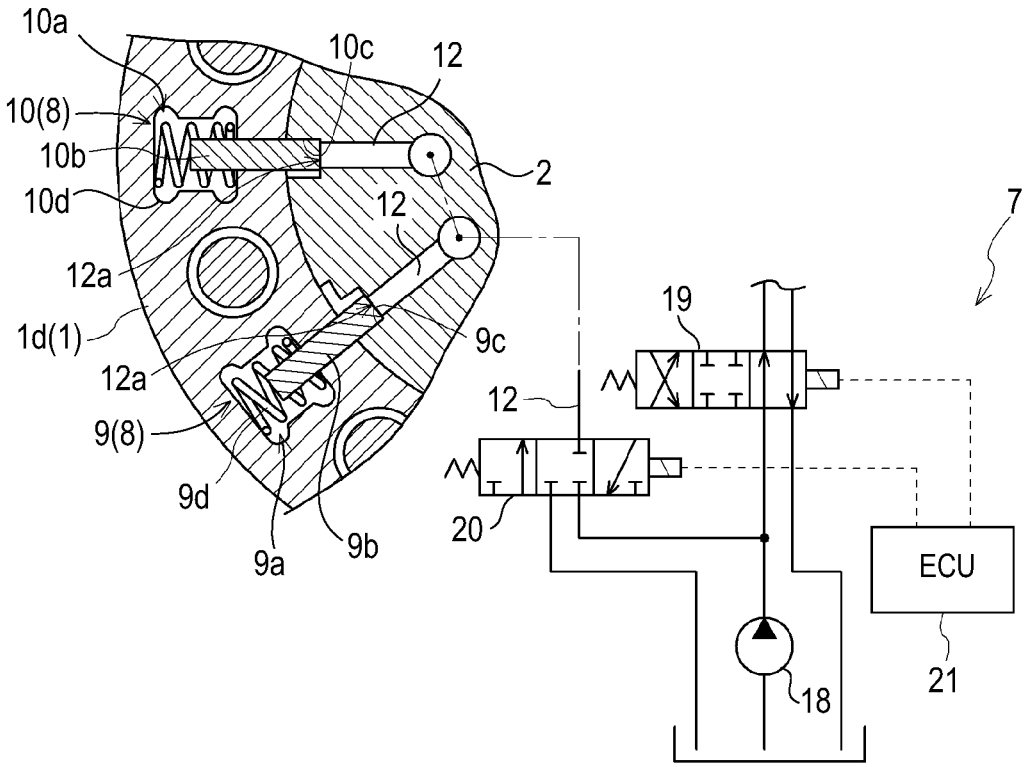
FIG. 6 is an enlarged cross-sectional view of a lock mechanism just after starting an engine.
Figure 7:
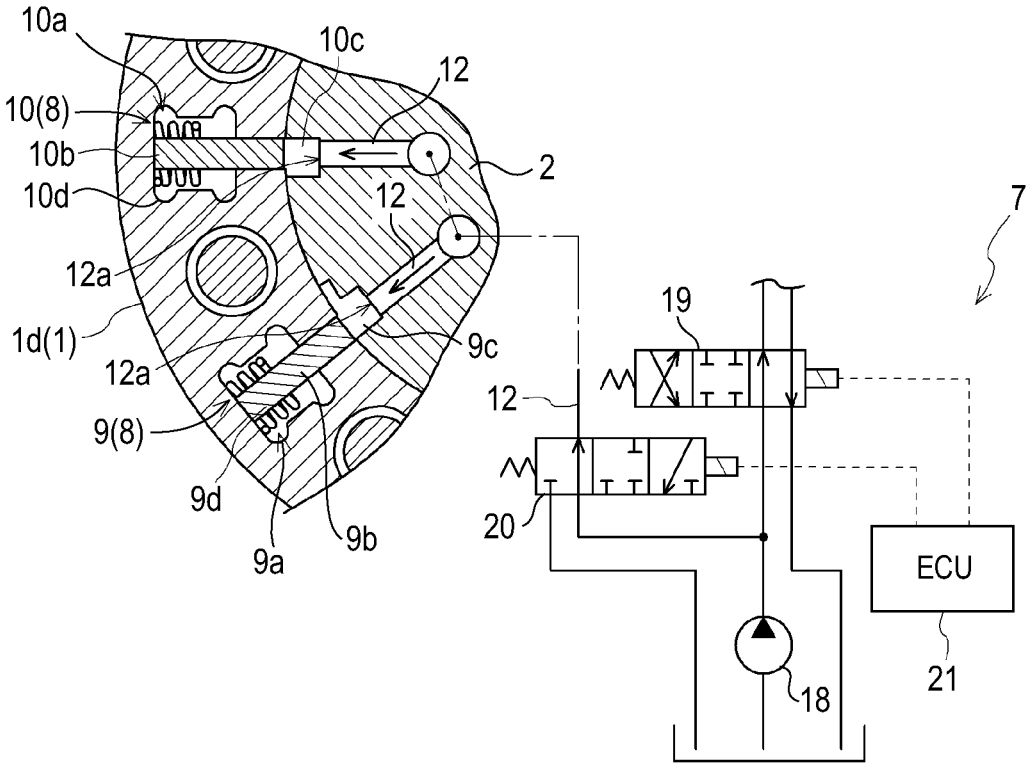
FIG. 7 is an enlarged cross-sectional view of the lock mechanism, which shows a lock release state.

The first concave portion 9*c* has a ratchet mechanism including broad grooves which open to an outer peripheral surface of the inner rotor 2 and narrow grooves opening to bottom faces of the broad grooves as shown in FIG. 5 to FIG. 7. In the embodiment, to fit the first lock member 9*b* into the first concave portion 9*c* indicates that the first lock member 9*b* enters into the narrow grooves.

In the first lock portion 9, when the first lock member 9*b* faces the first concave portion 9*c* by the relative rotation between the housing 1 and the inner rotor 2 in the state where the operating oil is discharged from the first concave portion 9*c* through the lock release flow path 12, the first lock member 9*b* enters into the broad grooves first due to the biasing force of the compressed coil spring 9*d*, then, enters into the narrow grooves.

In the second lock portion 10, when the second lock member 10*b* faces the second concave portion 10*c* by the relative rotation between the housing 1 and the inner rotor 2 in the state where the operating oil is discharged from the second concave portion 10*c* through the lock release flow path 12, the second lock member 10*b* enters the second concave portion 10*c* due to the biasing force of the compressed coil spring 10*d*. The width of the second concave portion 10*c* in a circumferential direction is the same as the width of the narrow grooves of the first concave portion 9*c*.

As shown in FIG. 6 and FIG. 7, the state where the first lock member 9*b* is fitted to the first concave portion 9*c* as well as the second lock member 10*b* is fitted to the second concave portion 10*c* corresponds to the lock state in which the relative rotation phase of the inner rotor 2 with respect to the housing 1 is constrained to the intermediate lock phase. As shown in FIG. 7, the state where the first lock member 9*b* is retracted from the first concave portion 9*c* as well as the second lock member 10*b* is retracted from the second concave portion 10*c* as the operating oil is supplied to the first concave portion 9*c* and the second concave portion 10*c* through the lock release flow paths 12 corresponds to the lock release state in which the relative rotation phase is not constrained. The switching control between the lock state and the lock release state is performed by the ECU 21.

The fluid supply and discharge mechanism 7 according to the embodiment includes the oil pump 18 and the OSV 20 in addition to the OCV 19 as a switching mechanism, and the ECU 21 controls actuation of the oil pump 18, the OCV 19 and the OSV 20.

The OSV 20 is switched to the following three modes as the position of a spool valve is changed by the ECU 21 which controls the conduction amount. The three modes include a supply mode in which the operating oil is supplied to the first concave portion 9*c* and the second concave portion 10*c* through the lock release flow paths 12, a discharge mode in which the operation oil is discharged from the first concave portion 9*c* and the second concave portion 10*c* through the lock release flow paths 12 and a shutoff mode in which supply and discharge of the operation oil to and from the first concave portion 9*c* and the second concave portion 10*c* are shut off (valve is closed). In the embodiment, the OSV 20 is operated in the discharge mode when the conduction amount is the maximum, in the supply mode when the conduction is cut off and in the shutoff mode when the duty of the conduction amount is 50%.

Next, the operation of the valve timing control apparatus A will be explained. In the state where ignition is turned off and the engine B is stopped, the valve timing control apparatus A is in the lock state in which the relative rotation phase of the inner rotor 2 with respect to the housing 1 is constrained to the intermediate lock phase, and the first lock member 9*b* and the second lock member 10*b* are fitted to the first concave portion 9*c* and the second concave portions 10*c*. At this time, the first lock member 9*b* and the second lock member 10*b* are biased by the compressed oil springs 9*d* and 10*d*.

As the conduction to the OSV 20 is cut off in the state where the engine B is stopped, the OSV 20 is switched to the supply mode as shown in FIG. 5. However, as the oil pump 18 is not driven in the state where the engine B is stopped, the operating oil is not supplied to the first concave portion 9*c* and the second concave portion 10*c*. Accordingly, there is little operating oil in the lock release flow paths 12, and air mainly exists there.

When the engine B is started, the ECU 21 controls the OSV 20 to be conducted at 50%, and the OSV 20 is switched to the shutoff mode as shown in FIG. 6. Accordingly, neither supply nor discharge of the operation oil is performed with respect to the lock release flow paths 12, and the the lock release flow paths 12 are closed by the first lock member 9*b*, the second lock member 10*b* and the OSV 20. At this time, the OCV 19 is switched to the timing advance mode, and the operating oil is supplied to the timing advance chamber 3*a* through the timing advance flow path 6*a*.

While the engine B is warmed up, the ECU 21 performs control of maintaining the lock state. In this state, even when the centrifugal force higher than the biasing force of the compressed coil springs 9*d* and 10*d* or the external force in the retracting direction caused due to the backlash between the housing 1 and the inner rotor 2 acts on the first lock member 9*b* and the second lock member 10*b*, air and the operating oil do not enter as the lock release flow paths 12 are closed by the first lock member 9*b*, the second lock member 10*b* and the OSV 20 in the same manner as the first embodiment. Accordingly, the force in the retracting direction is cancelled out or reduced by the negative pressure inside the lock release flow paths 12, therefore, the first lock member 9*b* and the second lock member 10*b* are not completely retracted. Additionally, a little amount of operating oil remains in a gap between the first lock member 9*b* and the first concave portion 9*c* as well as between the second lock member 10*b* and the second concave portion 10*c*, which secures the sealed state in the vicinity of two openings 12*a*, 12*a* of the lock release flow paths 12.

After that, when the warm-up of the engine B is finished and an accelerator is stepped on for starting normal driving of the vehicle, the ECU 21 controls the OSV 20 to cut off the conduction to thereby switch the OSV 20 to the supply mode, as a result, the operating oil is supplied to the first concave portion 9*c* and the second concave portion 10*c* through the lock release flow paths 12, and hydraulic pressure in the direction of releasing the lock acts on the first lock member 9*b* and the second lock member 10*b*. Due to the hydraulic pressure, the first lock member 9*b* and the second lock member 10*b* are respectively retracted from the first concave portion 9*c* and the second concave portion 10*c* against the biasing force of the compressed coil springs 9*d* and 10*d*, and the lock mechanism 8 becomes in the lock release state as shown in FIG. 7. At this time, the OCV 19 remains in the timing advance mode, and the supply of the operating oil to the timing advance chamber 3*a* has been completed. As a result, the relative rotation phase of the inner rotor 2 with respect to the housing 1 can be displaced in the timing advance direction S1 at the same time as the lock mechanism 8 becomes in the lock release state, which can improve accelerator response.

As described above, when the OSV 20 is switched to the shutoff mode just after starting the engine B, the centrifugal force or the external force in the retracting direction which may act on the first lock member 9*b* and the second lock member 10*b* is cancelled out or reduced by the negative pressure generated in the lock release flow paths 12, therefore, it is possible to prevent the first lock member 9*b* and the second lock member 10*b* from being retracted and from releasing the lock state against the control.

Third Embodiment

Figure 8:
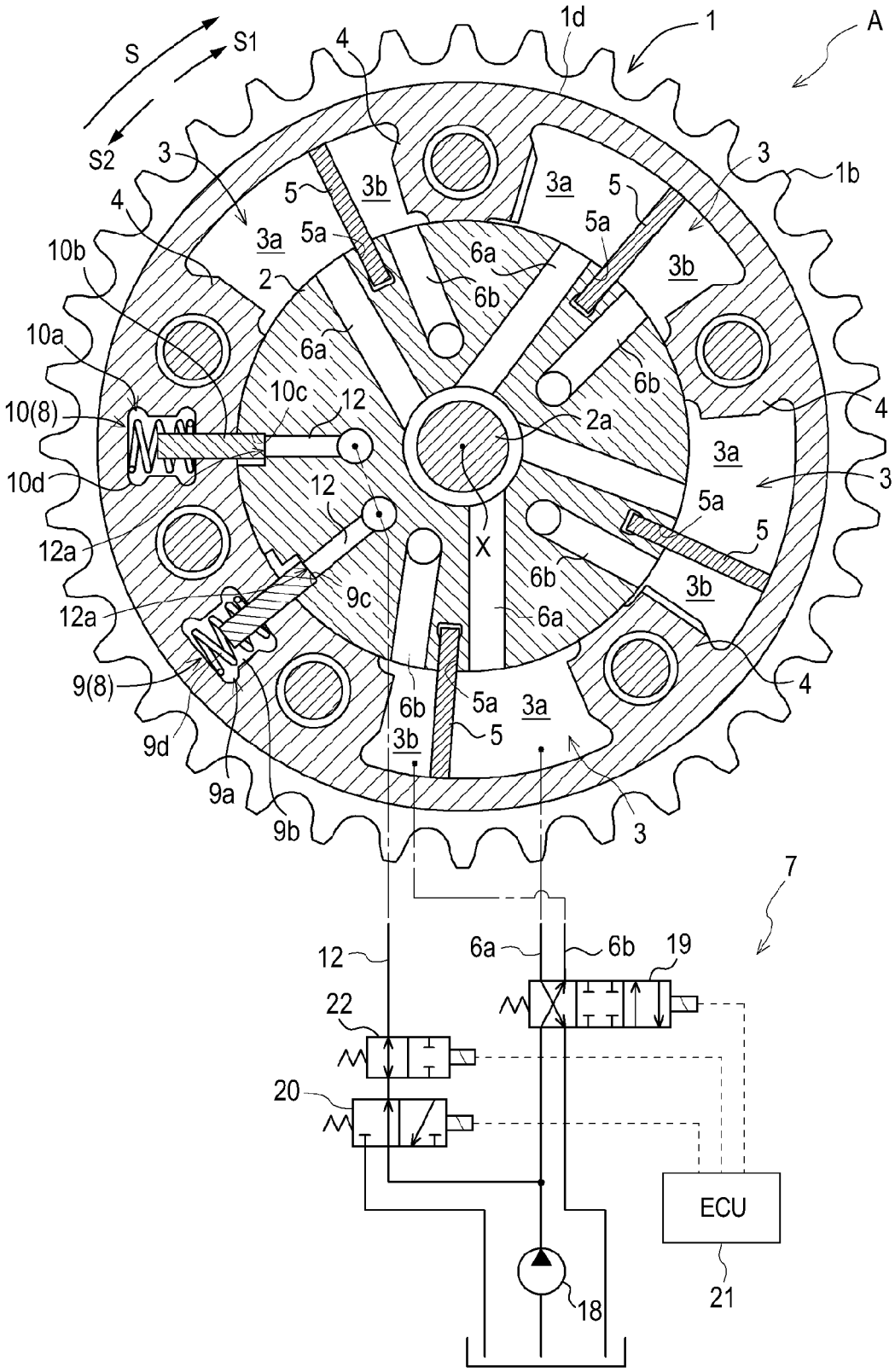
FIG. 8 is a horizontal cross-sectional view showing a structure of a valve timing control apparatus according to a third embodiment.

Next, a third embodiment disclosed here will be explained with reference to the drawings. The valve timing control apparatus A according to the embodiment differs from the second embodiment in a point that the OSV 20 having only two modes of the supply mode and the discharge mode is arranged and a solenoid valve 22 is arranged in series with the OSV 20 in the middle of the lock release flow path 12 as shown in FIG. 8, and other structures are the same. In the embodiment, the solenoid valve 22 is an example of a valve.

The solenoid valve 22 in the present embodiment is switched between a supply mode in which the operating oil can be supplied and discharged to and from the first concave portion 9*c* and the second concave portion 10*c* through the lock release flow paths 12, and a shutoff mode in which supply and discharge of the operating oil are shut off by changing the position of the spool valve based on the control of conduction/cutoff by the ECU 21.

As shown in FIG. 8, in the valve timing control apparatus A according to the present embodiment, both the OSV 20 and the solenoid valve 22 are switched to the supply mode in the state where the engine B is stopped. At this time, the device is in the lock state in which the relative rotation phase of the inner rotor 2 with respect to the housing 1 is constrained to the intermediate lock phase. There is little operating oil in the lock release flow paths 12 and air mainly exists.

Figure 9:
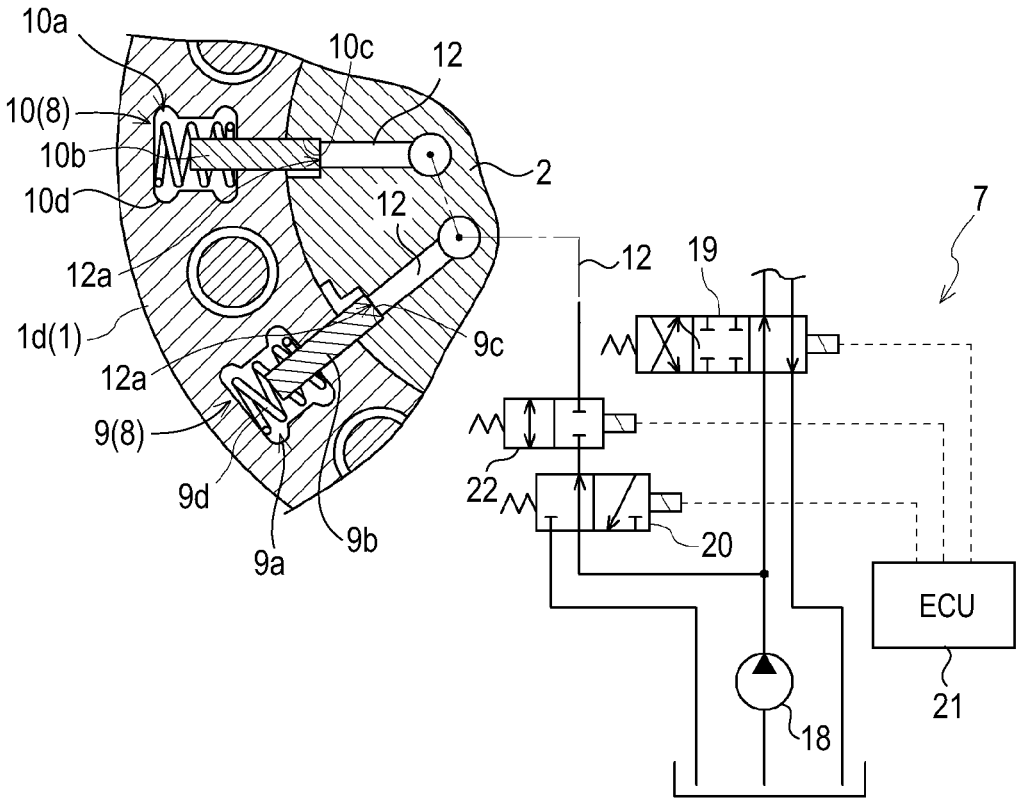
FIG. 9 is an enlarged cross-sectional view of a lock mechanism just after starting an engine.

As shown in FIG. 9, when the engine B is started, the ECU 21 immediately controls the solenoid valve 22 to be conducted, and the solenoid valve 22 is switched to the shutoff mode. At this time, the OSV 20 remains in the supply mode, therefore, the operating oil is discharged from the oil pump 18 toward the lock release flow paths 12 and reaches the OSV 20. However, as the solenoid valve 22 is in the shutoff mode, the operating oil is not supplied to the lock release flow paths 12, therefore, the lock release flow paths 12 are closed by the first lock member 9*b*, the second lock member 10*b* and the OSV 20.

In this state, even when the centrifugal force higher than the biasing force of the compressed coil springs 9*d* and 10*d* or the external force in the retracting direction caused due to the backlash between the housing 1 and the inner rotor 2 acts on the first lock member 9*b* and the second lock member 10*b*, air does not enter as the lock release flow paths 12 are closed by the first lock member 9*b*, the second lock member 10*b* and the solenoid valve 22 in the same manner as the second embodiment. Accordingly, the force in the retracting direction is cancelled out or reduced by the negative pressure inside the lock release flow paths 12, and the first lock member 9*b* and the second lock member 10*b* are not completely retracted.

Figure 10:
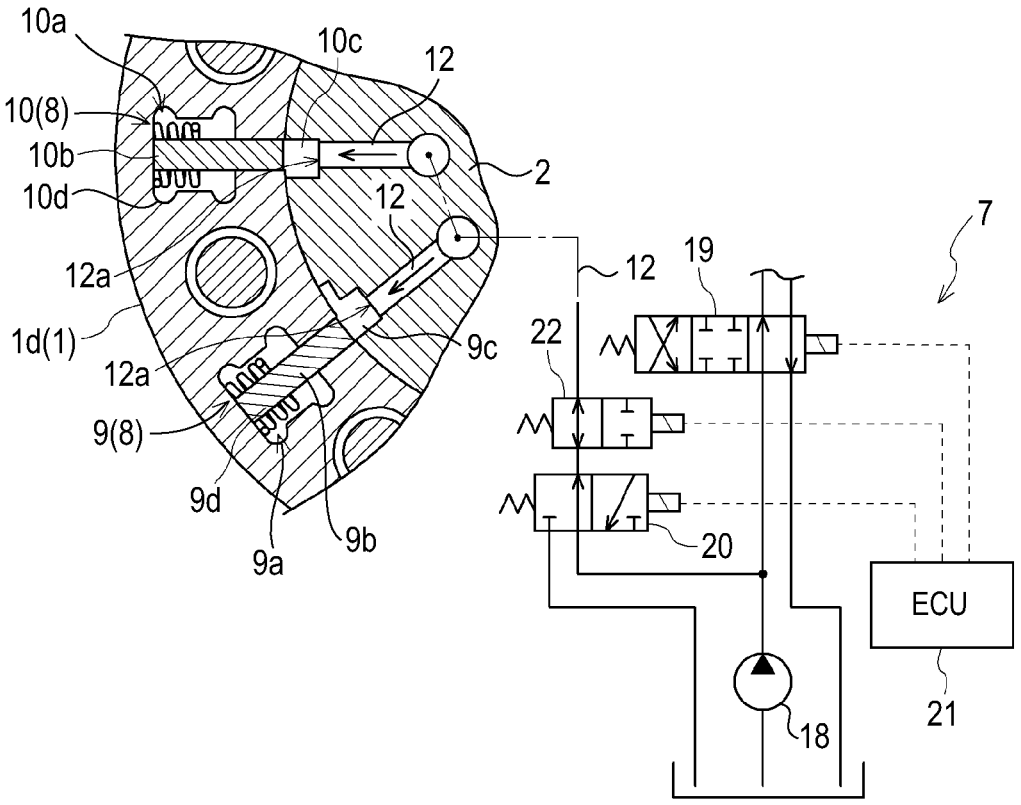
FIG. 10 is an enlarged cross-sectional view of the lock mechanism, which shows a lock release state.

After that, when the warm-up of the engine B is finished and an accelerator is stepped on for starting normal driving of the vehicle, the ECU 21 controls the solenoid valve 22 to cut off the conduction to thereby switch the solenoid valve 22 to the supply mode. The operating oil which has reached the OSV 20 is supplied to the first concave portion 9*c* and the second concave portion 10*c* through the lock release flow paths 12 and hydraulic pressure in the direction of releasing the lock acts on the first lock member 9*b* and the second lock member 10*b*. Due to the hydraulic pressure, the first lock member 9*b* and the second lock member 10*b* are respectively retracted from the first concave portion 9*c* and the second concave portion 10*c* against the biasing force of the compressed coil springs 9*d* and 10*d*, and the lock mechanism 8 becomes in the lock release state as shown in FIG. 10.

As described above, also in the case where the two-mode OSV 20 and the solenoid valve 22 are provided, it is possible to prevent the first lock member 9*b* and the second lock member 10*b* from being retracted and from releasing the lock state against the control if the centrifugal force or the external force in the retracting direction acts on the first lock member 9*b* and the second lock member 10*b* by switching the solenoid valve 22 to the shutoff mode just after starting the engine B.

The valve timing control apparatus A belonging to the type in which the first lock member 9*b* and the second lock member 10*b* are ejected and retracted in the radial direction centered on the rotation shaft center X has been explained in the first embodiment to the third embodiment, however, the disclosure is not limited to this. Also in the valve timing control apparatus A belonging to a type in which the first lock member 9*b* and the second lock member 10*b* are ejected and retracted along the rotation shaft center X, it is possible to prevent the first lock member 9*b* and the second lock member 10*b* from being retracted and from releasing the lock state against the control of maintaining the lock state by performing the same control using the OCV 19, the OSV 20 and the solenoid valve 22.

The disclosure can be applied to the valve timing control apparatus controlling the relative rotation phase of the driven-side rotor with respect to the drive-side rotor rotating in synchronization with the crankshaft of the internal combustion engine.

An aspect of this disclosure provides a valve timing control apparatus including a drive-side rotor rotating in synchronization with a crankshaft of an internal combustion engine, a driven-side rotor arranged so as to have the same shaft center as the drive-side rotor, rotating in synchronization with a camshaft for opening and closing valves in the internal combustion engine, a fluid pressure chamber formed between the drive-side rotor and the driven-side rotor, a partitioning portion provided in at least one of the drive-side rotor and the driven-side rotor, a timing advance chamber and a timing delay chamber formed by partitioning the fluid pressure chamber by the partitioning portion, a lock mechanism having a lock member housed in any one of the drive-side rotor and the driven-side rotor and arranged so as to be ejected and retracted with respect to the other of the drive-side rotor and the driven-side rotor, and a concave portion formed in the other rotor so as to be fitted when the lock member is ejected, in which switching can be performed between a lock state where the lock member is ejected to be fitted to the concave portion to thereby allow a relative rotation phase of the driven-side rotor with respect to the drive-side rotor to be constrained to a given phase and a lock release state where the lock member is retracted from the concave portion to thereby release the constraint, a lock release flow path through which operating fluid supplied and discharged to and from the concave portion is circulated, a valve arranged in the middle of the lock release flow path, having a shutoff mode in which neither supply nor discharge of the operating fluid to and from the concave portion is performed and a control unit controlling the operation of the valve, in which the valve becomes in the shutoff mode just after the internal combustion engine is started to thereby shut off supply and discharge of the operating fluid to and from between the valve in the lock release flow path and the concave portion.

The state where the internal combustion engine is stopped corresponds to the lock state where there is no operating fluid in the concave portion and the lock release flow path, the lock member is fitted to the concave portion and air mainly exists in the lock release flow path. At this time, the lock member closes the opening of the lock release flow path on the concave side, and air mainly exists in the lock release flow path. When the internal combustion engine is started after that, the control unit performs control of closing the valve as well as maintaining the lock state. In such case, the centrifugal force higher than the biasing force for biasing the lock member onto the concave portion or the external force in a retracting direction caused due to the backlash between the drive-side rotor and the driven-side rotor may act on the lock member. However, even when such centrifugal force or external force acts on the lock member to be retracted, the lock member is not completely retracted. This is because negative pressure is generated inside the lock release flow path against the operation of the force in the retracting direction of the lock member to thereby cancel out or reduce the force in the retracting direction onto the lock member because a flow path between the valve in the lock release flow path and the concave portion is closed by the valve and the lock member and not only supply and discharge of the operating fluid are not performed but also air does not enter.

As described above, when the valve is allowed to be in the shutoff mode just after the internal combustion engine is started, if the centrifugal force or the external force in the retracting direction acts on the lock member, the external force is cancelled out or reduced by the negative pressure generated in the lock release flow path, therefore, it is possible to prevent the lock member from being retracted and from releasing the lock state against the control by the control unit.

In the valve timing control apparatus, it is preferable that the valve further has a discharge mode in which the operating fluid can be discharged from the concave portion and a supply mode in which the operating fluid can be supplied to the concave portion.

In order to provide the discharge mode and the supply mode in the valve in addition to the shutoff mode, it is sufficient to change the shape of a spool. Accordingly, when compared with a case where a valve having the discharge mode and the supply mode is attached as a separate component anew, the case where the discharge mode and the supply mode are provided in the valve having the shutoff mode is advantageous from any of perspectives of the occupied area of the component, costs and man-hour for installation.

In the valve timing control apparatus, it is preferable that the lock member is ejected and retracted in a radial direction with respect to the shaft center.

In the valve timing control apparatus belonging to the type in which the lock member is ejected and retracted in the radial direction with respect to the shaft center, the centrifugal force in the retraction direction constantly acts on the lock member while the internal combustion engine is rotated. At this time, when the centrifugal force becomes higher than the biasing force biasing the lock member to the concave portion, the lock member may be retracted from the concave portion to be the lock release state. However, if the centrifugal force higher than the biasing force acts on the lock member, the force is cancelled out or reduced by the negative pressure generated in the lock release flow path by applying the above structure, therefore, it is possible to prevent the lock member from being retracted and from releasing the lock state against the control by the control unit.

In the valve timing control apparatus, it is preferable that the lock release flow path is formed independently of a timing advance flow path through which the operating fluid to be supplied and discharged to and from the timing advance chamber is circulated, and a timing delay flow path through which the operating fluid to be supplied and discharged to and from the timing delay chamber is circulated.

In the above structure, supply and discharge of the operating fluid to and from the timing advance chamber or the timing delay chamber can be performed at the same time as the valve is closed just after the internal combustion engine is started to thereby shut off the supply and discharge of the operating fluid to and from the lock release flow path. As a result, as the supply of the operating fluid to the timing advance chamber or the timing delay chamber has been completed just before the lock is released, therefore, the relative rotation phase of the driven-side rotor with respect to the drive-side rotor can be displaced immediately after the lock is released.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing control apparatus comprising:

a drive-side rotor rotating in synchronization with a crankshaft of an internal combustion engine;

a driven-side rotor arranged so as to have the same shaft center as the drive-side rotor, rotating in synchronization with a camshaft for opening and closing valves in the internal combustion engine;

a fluid pressure chamber formed between the drive-side rotor and the driven-side rotor;

a partitioning portion provided in at least one of the drive-side rotor and the driven-side rotor;

a timing advance chamber and a timing delay chamber formed by partitioning the fluid pressure chamber by the partitioning portion;

a lock mechanism including a lock member housed in any one of the drive-side rotor and the driven-side rotor and arranged so as to be ejected and retracted with respect to the other of the drive-side rotor and the driven-side rotor, and a concave portion formed in the other rotor so as to be fitted when the lock member is ejected, in which switching can be performed between a lock state where the lock member is ejected to be fitted to the concave portion to thereby allow a relative rotation phase of the driven-side rotor with respect to the drive-side rotor to be constrained to a given phase and a lock release state where the lock member is retracted from the concave portion to thereby release the constraint;

a lock release flow path through which operating fluid supplied and discharged to and from the concave portion is circulated;

a valve arranged in the middle of the lock release flow path, having a shutoff mode in which neither supply nor discharge of the operating fluid to and from the concave portion is performed; and a control unit controlling the operation of the valve, wherein the valve becomes in the shutoff mode just after the internal combustion engine is started to thereby shut off supply and discharge of the operating fluid to and from between the valve in the lock release flow path and the concave portion.

2. The valve timing control apparatus according to claim 1, wherein the valve further has a discharge mode in which the operating fluid can be discharged from the concave portion and a supply mode in which the operating fluid can be supplied to the concave portion.

3. The valve timing control apparatus according to claim 1, wherein the lock member is ejected and retracted in a radial direction with respect to the shaft center.

4. The valve timing control apparatus according to claim 2, wherein the lock member is ejected and retracted in a radial direction with respect to the shaft center.

5. The valve timing control apparatus according to claim 1, wherein the lock release flow path is formed independently of a timing advance flow path through which the operating fluid to be supplied and discharged to and from the timing advance chamber is circulated, and a timing delay flow path through which the operating fluid to be supplied and discharged to and from the timing delay chamber is circulated.

6. The valve timing control apparatus according to claim 2, wherein the lock release flow path is formed independently of a timing advance flow path through which the operating fluid to be supplied and discharged to and from the timing advance chamber is circulated, and a timing delay flow path through which the operating fluid to be supplied and discharged to and from the timing delay chamber is circulated.

7. The valve timing control apparatus according to claim 3, wherein the lock release flow path is formed independently of a timing advance flow path through which the operating fluid to be supplied and discharged to and from the timing advance chamber is circulated, and a timing delay flow path through which the operating fluid to be supplied and discharged to and from the timing delay chamber is circulated.

* * * * *